US006357222B1

(12) United States Patent
Schilling et al.

(10) Patent No.: US 6,357,222 B1
(45) Date of Patent: Mar. 19, 2002

(54) METHOD AND APPARATUS FOR REDUCING THERMAL STRESSES WITHIN TURBINE ENGINES

(75) Inventors: Jan C. Schilling, Middletown; Alfred A. Mancini, Cincinnati, both of OH (US)

(73) Assignee: General Electric Company, Cinncinnati, OH (US)

( * ) Notice: Subject to any disclaimer, the term of this patent is extended or adjusted under 35 U.S.C. 154(b) by 0 days.

(21) Appl. No.: 09/545,692

(22) Filed: Apr. 7, 2000

(51) Int. Cl.[7] ..... F02G 3/00
(52) U.S. Cl. ..... 60/39.32; 60/740
(58) Field of Search ..... 60/740, 39.32; 239/397.5

(56) References Cited

U.S. PATENT DOCUMENTS 2,595,566 A * 5/1952 Carey ..... 60/740
4,891,935 A * 1/1990 McLaurin et al. ..... 60/740
5,361,578 A * 11/1994 Donlan
5,423,178 A * 6/1995 Mains ..... 60/740
5,761,907 A * 6/1998 Pellitier et al. ..... 60/740
6,076,356 A * 6/2000 Pellitier ..... 60/740
6,149,075 A * 11/2000 Moertle et al. ..... 60/740

FOREIGN PATENT DOCUMENTS

FR 2 471 480 * 6/1981
WO WO 97/34108 * 9/1997

* cited by examiner

*Primary Examiner*—Charles G. Freay
(74) *Attorney, Agent, or Firm*—Andrew C. Hess; William Scott Andes

(57) ABSTRACT

A fuel injection system for use with a gas turbine engine includes a plurality of thermally compatible fuel nozzles. Each fuel nozzle includes a delivery system to deliver a fluid supply to the gas turbine engine and a support system for supporting the delivery system. The delivery system is disposed within the support system and is subjected to lower operating temperatures than the support system. The delivery system is fabricated from a material having a coefficient of expansion approximately twice a coefficient of expansion for the material used in fabricating the support system.

18 Claims, 2 Drawing Sheets

METHOD AND APPARATUS FOR REDUCING THERMAL STRESSES WITHIN TURBINE ENGINES

BACKGROUND OF THE INVENTION

This invention relates generally to gas turbine engines and, more particularly, to fuel delivery systems which include thermally compatible fuel nozzles for gas turbine engines.

Maximizing the life cycle of fuel nozzles installed within gas turbine engines extends the longevity of the gas turbine engine. Fuel nozzles are subjected to high temperatures when the gas turbine engine is operating. Such high temperatures induce thermal stresses on the fuel nozzles which often lead to a failure of the fuel nozzles or ultimately, a failure of the gas turbine engine.

Known fuel delivery systems include a plurality of fuel nozzles which include a delivery system and a support system. Each delivery system delivers fuel to the gas turbine engine and is supported and shielded within the gas turbine engine with the support system. The support system surrounds the delivery system and is thus subjected to higher temperatures than the supply system. To minimize the effects of the high temperatures, the support system is typically fabricated from a first material which has material characteristics, including a coefficient of expansion, which permit the support system to withstand the potentially high temperatures.

The delivery system is disposed within the support system and fluid flowing within the delivery system cools the delivery system. Accordingly, the delivery system is subjected to much lower temperatures. Typically the delivery system is fabricated from either the same material or a second material which is resilient to a lower range of temperatures and has a coefficient of expansion that is approximately equal to the support system material coefficient of expansion. As a result of the operating temperature differential between the delivery system and the support system, thermal stresses develop between the delivery system and support system as each system thermally expands.

BRIEF SUMMARY OF THE INVENTION

In an exemplary embodiment, a fuel injection system for use with a gas turbine engine includes a plurality of thermally compatible fuel nozzles. Each fuel nozzle includes a delivery system to deliver a fluid supply to the gas turbine engine and a support system for supporting the delivery system. Each delivery system is fabricated from a first material which has a first coefficient of expansion and is disposed within a respective support system. Each support system shields a respective delivery system and is fabricated from a second material which has a second coefficient of expansion. The second coefficient of expansion is approximately half the coefficient of expansion of the first material. A slip joint is disposed between the support system and the delivery system and compensates between the support system and the delivery system coefficients of expansion, such that both systems thermally expand in proportion to each respective system's material coefficient of expansion.

During operation, the delivery system is subjected to lower temperatures than the support system. Because the support system is fabricated from a material having a low coefficient of expansion and the delivery system is fabricated from a material having a high coefficient of expansion, differential expansion is less than if the two systems were fabricated from the same material. As a result, the effects of thermal expansion are minimized between the delivery system and the support system as each system thermally expands.

DETAILED DESCRIPTION OF THE INVENTION

Figure 1:
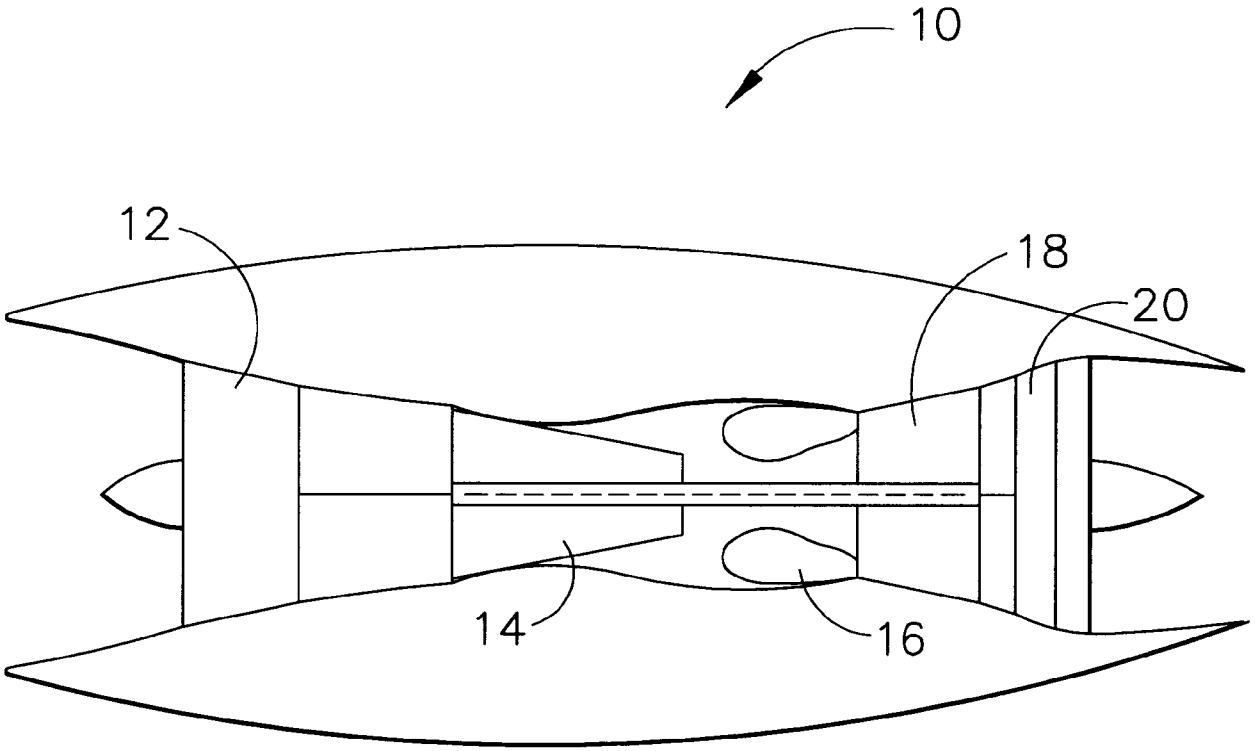
FIG. 1 a schematic of a gas turbine engine.

FIG. 1 is a schematic illustration of a gas turbine engine 10 including a low pressure compressor 12, a high pressure compressor 14, a combustor 16, a high pressure turbine 18, and a low pressure turbine 20. Combustor 16 includes a fuel injection system (not shown) including a plurality of fuel nozzles (not shown in FIG. 1) which inject a fluid supply to gas turbine engine 10. In one embodiment, the fuel nozzles are available from Parker-Hannifin Corporation.

In operation, air flows through low pressure compressor 12 to high pressure compressor 14. Highly compressed air is then delivered to combustor 16 simultaneously as the fuel fluid supply is delivered and ignited within combustor 16. Hot gases expand and drive turbines 18 and 20.

Figure 2:
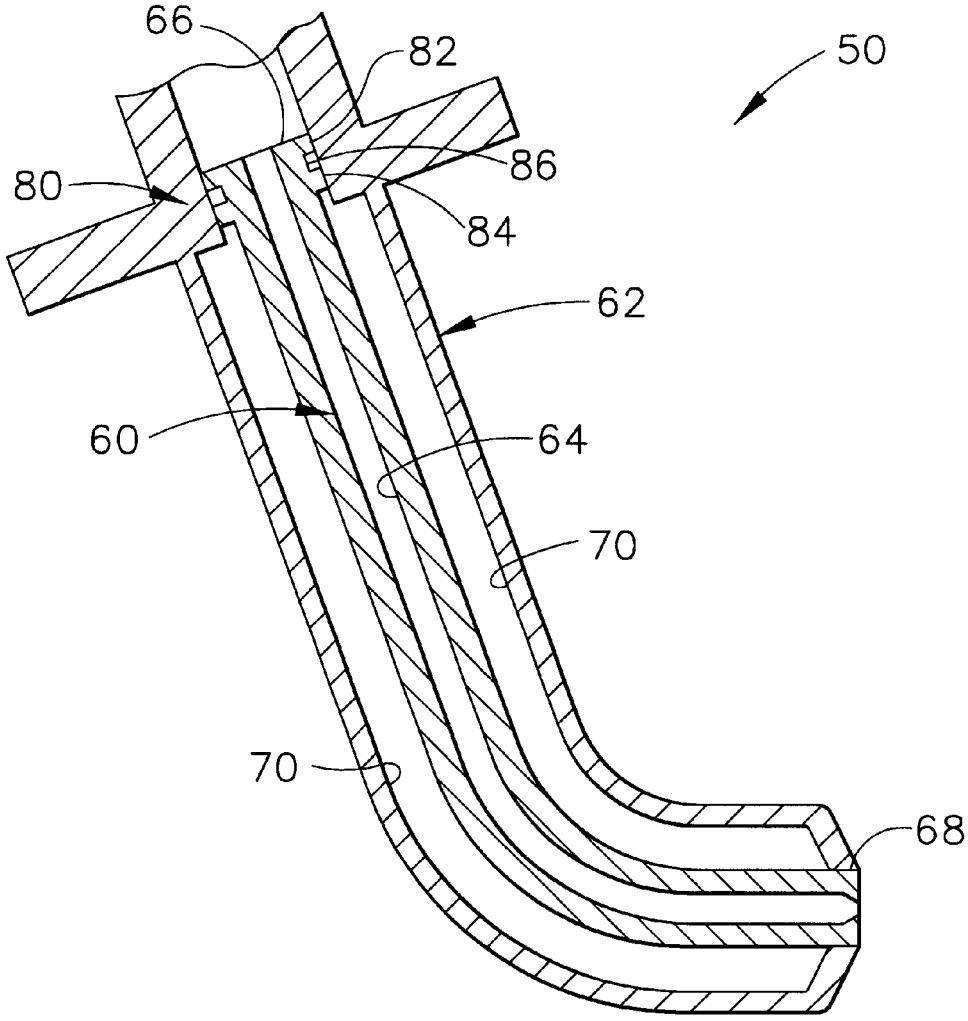
FIG. 2 is a side schematic view of one embodiment of a fuel nozzle that could be used in conjunction with the gas turbine engine shown in FIG. 1.

FIG. 2 is a side schematic cross-sectional view of one embodiment of a fuel nozzle 50 for use in conjunction with a gas turbine engine, such as turbine engine 10 (shown in FIG. 1). In one embodiment, fuel nozzle 50 is similar to the fuel nozzle disclosed in U.S. Pat. No. 5,269,468. Fuel nozzle 50 includes a delivery system 60 and a support system 62. Delivery system 60 includes a chamber 64 generally tubular shaped and extending from a first end 66 to a second end 68. Delivery system 60 is fabricated from a metal alloy material (not shown) having material characteristics to enable delivery system 60 to be withstand the range of temperatures delivery system 60 is exposed to during operation. In one embodiment, delivery system 60 is fabricated from a nickel metal alloy material such as a Hastelloy X® alloy material available from Haynes International, Kokomo, Indiana.

Support system 62 extends from delivery system first end 66 to delivery system second end 68. Support system 62 supports and surrounds delivery system 60 and is therefore exposed to a much higher range of temperatures than delivery system 60 as a result of hot gases exiting compressor 14 (shown in FIG. 1). Support system 62 is fabricated from a metal alloy material (not shown) having material characteristics which enable support system 62 to withstand the range of temperatures support system 62 is exposed to during operation. The support system metal alloy material has a coefficient of expansion approximately one half the coefficient of expansion of the metal alloy material used in fabricating delivery system 60. In one embodiment, support system 62 is fabricated from a nickel-cobalt-iron metal alloy material such as an Incoloy® alloy 900 series material available from SMC Metal, Incorporated, Fullerton, Calif.

A dead air cavity 70 circumferentially surrounds delivery system chamber 64 extending from fuel nozzle delivery first end 66 to delivery system second end 68. Dead air cavity 70 is disposed between support system 62 and delivery system 60 and thermally insulates delivery system 60 from support system 62. Because dead air cavity 70 thermally insulates delivery system 60 and because fluid flow within chamber 64 helps to cool delivery system 60, support system 62 is subjected to higher temperatures than delivery system 60. To compensate for the difference in temperatures that support system 62 and delivery system 60 are exposed to during operation, fuel nozzle 50 includes a slip joint 80.

Slip joint 80 is disposed between delivery system 60 and support system 62 and includes a flange 82. Flange 82 includes a groove 84 sized to receive an o-ring 86 in sealable contact between delivery system 60 and support system 62 to prevent fluid flow from entering dead air cavity 70.

During operation of gas turbine engine 10, fuel and air flow through gas turbine engine 10 at a high temperature and velocity. The high temperatures of the fuel and air subject fuel nozzle 50 to thermal stresses and thermal growths. Fuel nozzle support system 62 is exposed to higher temperatures than fuel nozzle delivery system 60. Fuel nozzle delivery system 60 is fabricated from a material which has a coefficient of expansion approximately twice as high as an associated coefficient of expansion of the material used in fabricating fuel nozzle support system 62. Accordingly, each system 60 and 62 thermally expands in proportion to a coefficient of expansion of the associated material used in fabricating each system. Chamber 64 permits delivery system 60 to deliver fluid from a fluid supply (not shown) to gas turbine engine 10 and cools delivery system 60 in the process. Furthermore, because fuel nozzle delivery system 60 is exposed to lower temperatures than support system 62, fuel nozzle delivery system 60 expands at a rate of expansion approximately twice an associated rate of expansion of fuel nozzle support system 62. However, because of the difference in each system's material coefficients of expansion, differential expansion between systems 60 and 62 is minimized. As a result, thermal stresses between support system 62 and delivery system 60 are minimized.

The above described fuel delivery system for a gas turbine engine is cost-effective and reliable. The fuel delivery system includes a plurality of fuel nozzles, each of which includes a delivery system and a support system. Each system expands independently and proportionally to each respective system's material coefficient of expansion. The effects of differential expansion between the two systems is minimized. Accordingly, thermal stresses between the delivery system and the support system are minimized. As a result, a reliable and durable fuel nozzle is provided for a gas turbine engine.

While the invention has been described in terms of various specific embodiments, those skilled in the art will recognize that the invention can be practiced with modification within the spirit and scope of the claims.

What is claimed is:

1. A method for fabricating a fuel nozzle for a gas turbine engine, the fuel nozzle including a delivery system and a support system, the delivery system configured to deliver fluid to the gas turbine engine, the support system configured to support the delivery system, said method comprising the steps of:

fabricating a fuel nozzle support system from a first material having a first coefficient of expansion;

fabricating a fuel nozzle delivery system from a second material having a second coefficient of expansion higher than the first coefficient of expansion of the fuel nozzle support system first material; and assembling the fuel nozzle with the fuel nozzle delivery system and the fuel nozzle support system such that the support system shields the delivery system.

2. A method in accordance with claim 1 wherein the fuel nozzle first material is a metal alloy, said step of fabricating a fuel nozzle delivery system further comprising the step of fabricating a fuel nozzle delivery system thermally compatible with the fuel nozzle support system.

3. A method in accordance with claim 2 wherein the fuel nozzle support system first material is a metal alloy material having a coefficient of expansion approximately half the coefficient of expansion of the fuel nozzle delivery system second material, said step of fabricating a fuel nozzle support system further comprising the step of fabricating the fuel nozzle support system from a material having a coefficient of expansion approximately half the coefficient of expansion of the material used in fabricating the delivery system.

4. A method in accordance with claim 3 further comprising the step of fabricating a slip joint disposed between the fuel nozzle delivery system and the fuel nozzle support system.

5. A fuel nozzle for a gas turbine engine, said fuel nozzle comprising:

a delivery system configured to deliver a fluid supply to the gas turbine engine, said delivery system comprising a first material having a first coefficient of expansion; and a support system configured to support said delivery system, said support system comprising a second material having a second coefficient of expansion, said delivery system coefficient of expansion higher than said support system coefficient of expansion.

6. A fuel nozzle in accordance with claim 5 wherein said delivery system coefficient of expansion is approximately twice said support system coefficient of expansion.

7. A fuel nozzle in accordance with claim 6 wherein said first material comprises a metal alloy material.

8. A fuel nozzle in accordance with claim 7 wherein said second material comprises a metal alloy material.

9. A fuel nozzle in accordance with claim 6 further comprising a slip joint between said delivery system and said support system.

10. A fuel nozzle in accordance with claim 9 wherein said slip joint comprises an o-ring in sealable contact between said delivery system and said support system.

11. A fuel nozzle in accordance with claim 6 further comprising a cavity between said delivery system and said support system.

12. A fuel injection system for a gas turbine engine, said fuel delivery system comprising:

a plurality of nozzles configured to deliver a fuel to the gas turbine engine, each of said nozzles comprising a delivery system and a support system, each said nozzle delivery system configured to deliver a fluid supply to the engine and comprising a first material having a first coefficient of expansion, each said support system configured to support said delivery system and comprising a second material having a second coefficient of expansion, said first coefficient of expansion higher than said second coefficient of expansion.

13. A fuel injection system in accordance with claim 12 wherein said first coefficient of expansion is approximately twice said second coefficient of expansion.

14. A fuel injection system in accordance with claim 13 wherein said nozzle delivery system first material comprises a metal alloy material.

15. A fuel injection system in accordance with claim 14 wherein said fuel nozzle support system second material comprises a metal alloy material.

16. A fuel injection system in accordance with claim 13 wherein each said nozzle further comprises a cavity between said support system and said delivery system.

17. A fuel injection system in accordance with claim 16 wherein each said nozzle further comprises a slip joint between said support system and said delivery system, said slip joint configured to prevent the fluid supply from entering said cavity.

18. A fuel injection system in accordance with claim 17 wherein each said slip joint further comprises an o-ring in sealable contact between said fuel nozzle delivery system and said fuel nozzle support system.

* * * * *